US005818171A

United States Patent [19]

Kim et al.

[11] Patent Number: 5,818,171

[45] Date of Patent: Oct. 6, 1998

[54] DEVICE FOR REMOVING ELECTRIC FIELD OF DISPLAY

[75] Inventors: Young-Min Kim; Tae-Sung Kim, both of Kyungki-do, Rep. of Korea

[73] Assignee: SamSung Electronics Co., Ltd., Kyungki-do, Rep. of Korea

[21] Appl. No.: 782,638

[22] Filed: Jan. 14, 1997

[30] Foreign Application Priority Data

Jan. 16, 1996 [KR] Rep. of Korea ..... 1996 720
Aug. 23, 1996 [KR] Rep. of Korea ..... 1996 25526

[51] Int. Cl.[6] ..... H01J 29/06

[52] U.S. Cl. ..... 315/8; 315/85; 348/820

[58] Field of Search ..... 315/8, 85; 348/819, 348/820

[56] References Cited

U.S. PATENT DOCUMENTS 3,369,074 2/1968 Massa ..... 348/820
5,151,635 9/1992 Cappels ..... 315/8
5,198,729 3/1993 Powell ..... 315/8 X
5,260,626 11/1993 Takase et al. ..... 315/85
5,363,022 11/1994 Kitou et al. ..... 315/8 X
5,365,285 11/1994 Kizuya et al. ..... 348/819 X
5,485,056 1/1996 Sasaki et al. ..... 315/8

*Primary Examiner*—Robert J. Pascal
*Assistant Examiner*—Justin P. Bettendorf
*Attorney, Agent, or Firm*—Robert E. Bushnell, Esq.

[57] ABSTRACT

A device for removing electric field of a display according to the present invention comprises: a voltage generator connected to a horizontal deflection output circuit of a CRT and generating an antiphase reverse pulse having a frequency band equal to that of a horizontal output pulse; a reverse pulse sensor made of a conductive material, insulated at a given location in the front part of the CRT, and generating the reverse pulse around the CRT; and a connector for detecting the reverse pulse of the voltage generator, connected to ground at one end thereof and the reverse pulse sensor at the other end thereof, and sending the reverse pulse to the reverse pulse sensor.

20 Claims, 6 Drawing Sheets

DEVICE FOR REMOVING ELECTRIC FIELD OF DISPLAY

CLAIM OF PRIORITY

This application makes reference to, incorporates the same herein, and claims all benefits accruing under 35 U.S.C §119 from an application entitled *Device For Removing Electric Field of Display* earlier filed in the Korean Industrial Property Office on 16 Jan. 1996, and there duly assigned Serial No. 1996-720 by that Office and from Korean Model Utility Patent Application No. 96-25526 filed on 23 Aug. 1996.

BACKGROUND OF THE INVENTION

1. Field of the Invention

The present invention relates to a device for removing an electric field of a display and, more particularly to, a device for removing an electric field of a display so as to interrupt or reduce a harmful electric wave caused by a clock oscillation in a cathode ray tube display.

2. Discussion of Related Art

With an increasing interest in harmful electromagnetic waves generated by electronic products (for example, a TV, a computer and so on) in recent years, an electromagnetic impulse (EMI) test is widely carried out in all countries that make electronic products so as to manufacture products that will meet the EMI standard requirement. Particularly in a display employing a CRT, the electric and magnetic fields generated from the CRT are detrimental to the human body and necessarily restricted in all the countries through the related various control facilities in all the countries.

The TCO, a typical system for testing and regulating the harmful electromagnetic waves in Europe, restricts the waves by the limited values as shown in Table 1.

TABLE 1

| PARAMETER | FREQUENCY BAND | LIMITED VALUE | REF. |
|---|---|---|---|
| ELECTRIC | ELF(5Hz~2KHz) | 10 V/M | ELF: EXTREMELY |
| FIELD | VLF(2KHz~400KHz) | 1 V/M | LOW FREQUENCY |
| MAGNETIC | ELF(5Hz~2KHz) | 200 nT | VLF: VERY LOW |
| FIELD | VLF(2KHz~400KHz) | 25 nT | FREQUENCY |

As shown in table 1, in the ELF region, a general CRT satisfies the limited TCO values which are considerably large in the region. Because a relatively small limited value is needed in the VLF region, a general but high-quality CRT is somewhat difficult to make.

As for the factors that induce the magnetic and electric fields strictly regulated as above, the former is generated by the voltage of a deflecting coil and the latter is by the voltage of an anode.

While the magnetic field can be easily screened by compensating the deflecting coil attached to the electron gun of the CRT and using a special cancelling coil together with the deflecting coil, the electric field which is generated by the voltage of the anode cannot be screened with ease.

One of the most popular methods of screening the electric field in the CRT is attaching a special filter to the front side of the CRT, because the front side is made of glass and thus difficult to be shut out of the electric field with a simple case unlike the lateral and back sides which can be screened from the electric and magnetic fields generating from the monitor. It has also been tried to employ a specially coated CRT so as to lower the coating resistance of the CRT to about $10^3\Omega$ or less in another method of screening the electric field. However, the special filter for screening the electric field is not practical because it is of a high price for a large-scaled process and also required to be mechanically attached to the front side of a display. Further, the coating liquid to obtain a coating resistance of $10^{-3}\Omega$ or less is very expensive and requires a technical skill to use.

U.S. Pat. No. 5,198,729, by Robert J. Powell and entitled *CRT Monitor With Elimination Of Unwanted Time Variable Electric Field*, contemplates one method contrived to solve the above problem. The method is to apply high voltage pulses, equal and opposite to (antiphase) the causative voltage pulses of the unwanted electric field, to the inner coating and the anode button. According to the foregoing method, the conventional manufacturing line of the CRT is useless because the CRT has to be newly designed including a part symmetrical to the anode. Further, it is required to carry out an additional coating process for coating an insulating layer on the outer wall of the CRT vacuum tube. The above method is also advantageously applicable only to a small-sized CRT because the electric field generated from the anode voltage must be screened with a voltage signal whose phase is inverted at a symmetric site of the anode.

U.S. Pat. No. 5,260,626, by Katsuhisa Takase, et al. entitled *Apparatus For Suppressing Field Radiation From Display Device*, contemplates another method for removing an unwanted electric field by using a degaussing coil arranged in the proximity of the peripheral front edge of a cathode ray tube. The degaussing coil is provided with a voltage antiphase to the unwanted electric field. A problem with the aforementioned method is the use of timed relays for controlling the degaussing operation.

U.S. Pat. No. 5,363,022, by Kouji Kitou, et al. entitled *Horizontal Defection Circuit With Reduced VLF Electric Fields From CRT Displays*, contemplates a method for removing an unwanted electric field of VLF emitted from the horizontal deflection yoke by using the flyback signal. The foregoing method, however, uses two horizontal drive circuits and two horizontal deflection yokes thereby increasing power consumption and manufacturing costs.

SUMMARY OF THE INVENTION

Accordingly, the present invention is directed to a device for removing an electric field of a display that substantially obviates one or more of the problems due to limitations and disadvantages of the related art.

An object of the present invention is to provide a device for removing an electric field of a display which is caused by the high voltage of an anode.

Another object of the present invention is to provide a device for removing an electric field of a display to a degree that meets the limited value in a VLF frequency band of the TCO regulations even with a general CRT.

Still another object of the present invention is to provide a device for removing an electric field of the CRT display by inserting a metal plate of conductive material into a space secured by the linkage of the CRT and its front case.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for removing electric field of a display according to the present invention comprises: a voltage generator connected to a horizontal deflection output circuit of a CRT and generating an antiphase reverse pulse having a frequency band equal to that of a horizontal output pulse; a reverse pulse sensor made of a conductive material, insulated at a given location in the front part of the CRT, and generating the reverse pulse around the CRT; and a connector for detecting the reverse pulse of the voltage generator, spontaneously connected to ground at one end thereof and the reverse pulse sensor at the other end thereof, and transferring the reverse pulse to the reverse pulse sensor.

It is to be understood that both the foregoing general description and the following detailed description are exemplary and explanatory and are intended to provide further explanation of the invention as claimed.

In another aspect, the present invention provides a transformer which has primary and secondary coils, the primary coil connected to the collector terminal of a horizontal output transistor and a horizontal size-regulating circuit, the secondary coil receiving a horizontal fly-back waveform and generating the antiphase of the signal applied to the primary coil.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention, wherein.

Figure 5A:
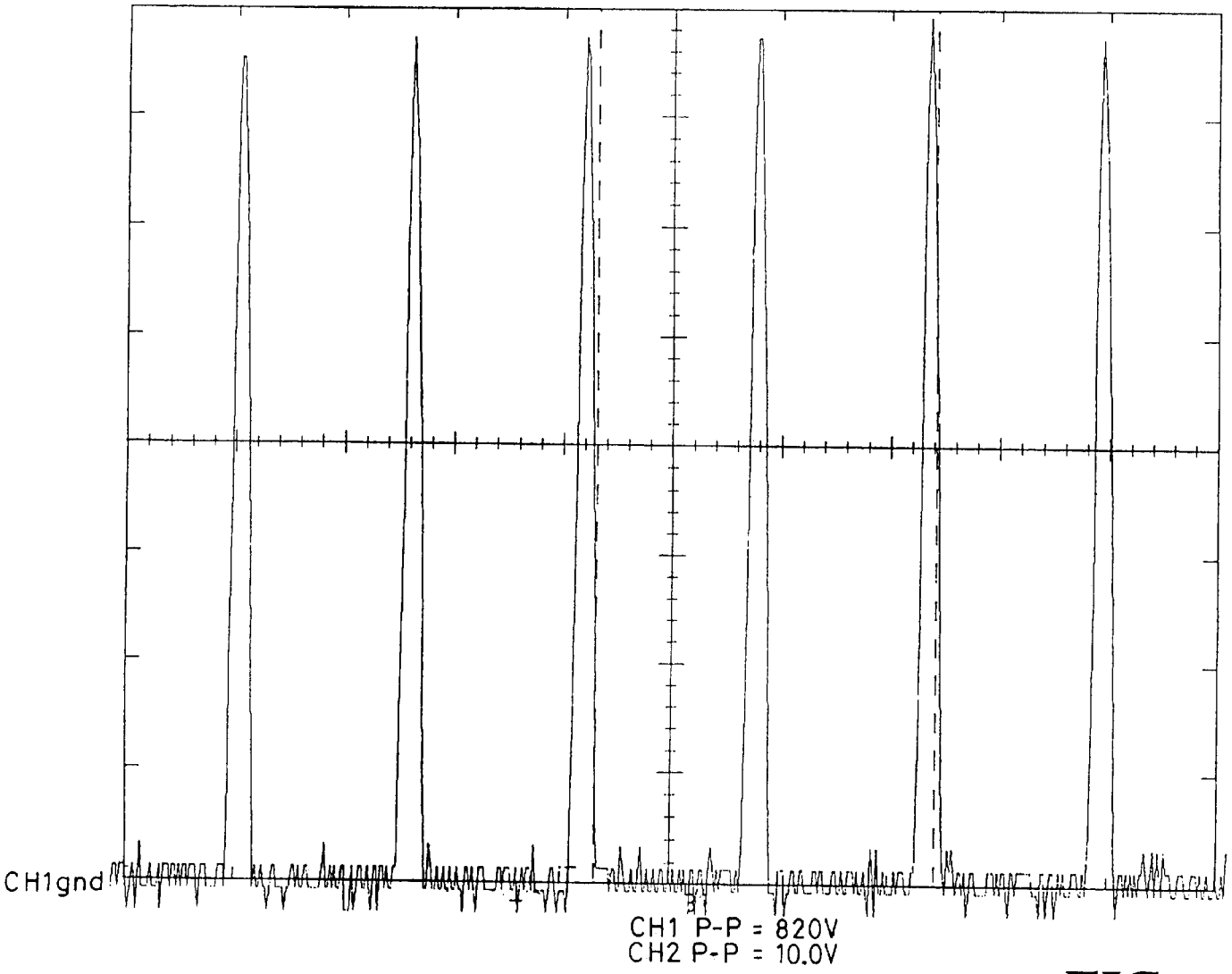
Figure 5B:
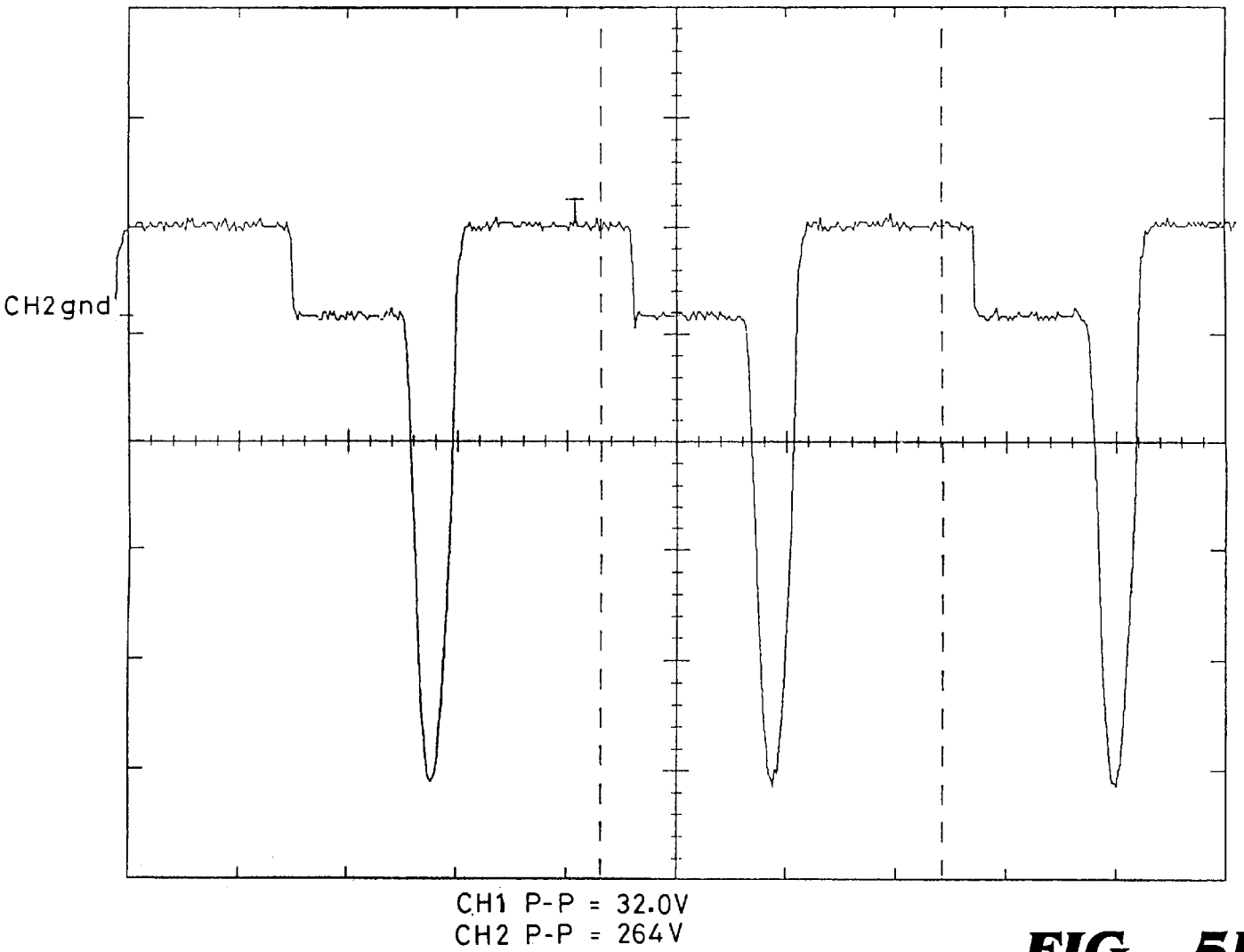
Figure 5C:
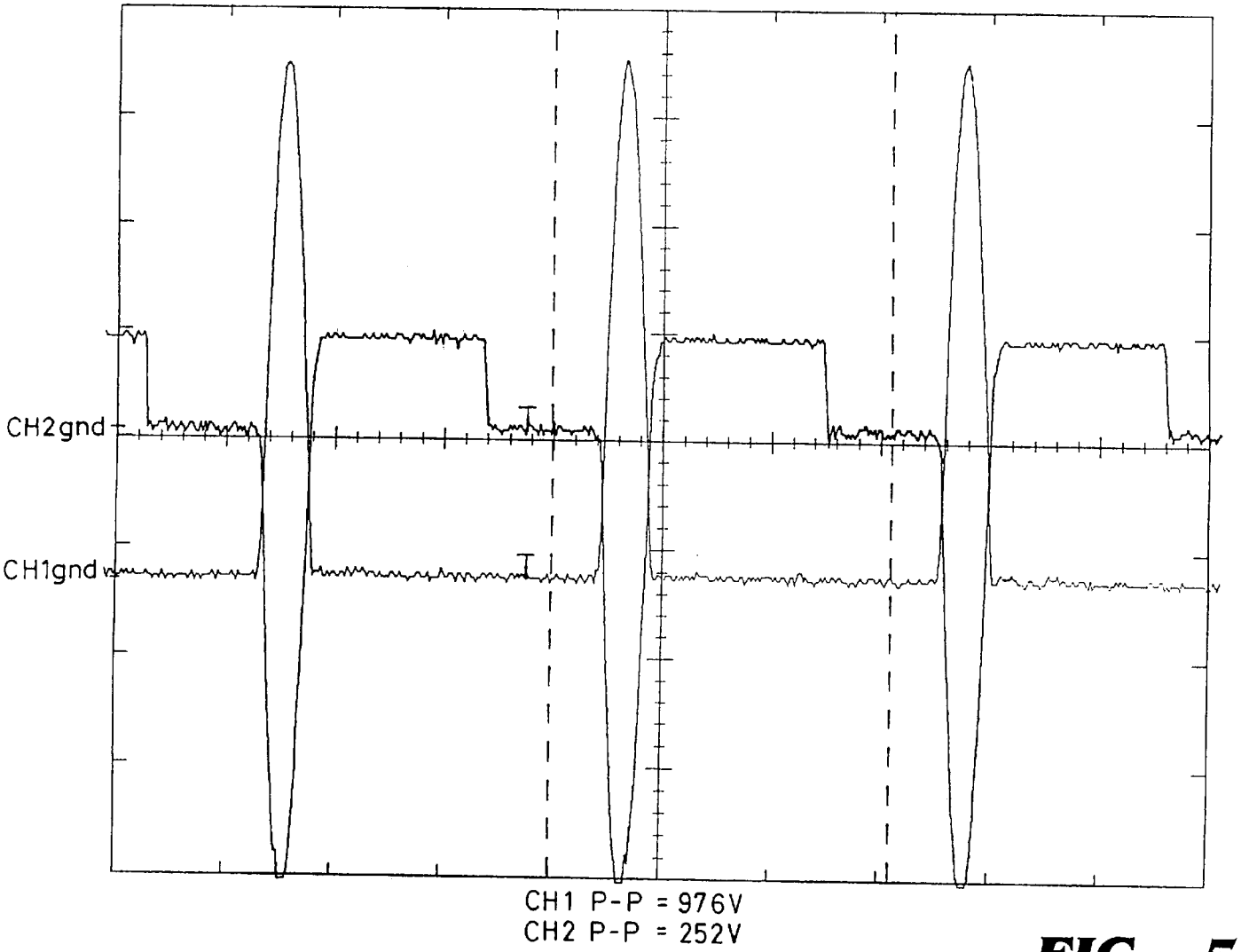

FIGS. 5(A) through 5(C) are waveform diagrams of the antiphase signal in accordance with the present invention.

DETAILED DESCRIPTION OF PREFERRED EMBODIMENT

Reference will now be made in detail to the preferred embodiments of the present invention, examples of which are illustrated in the accompanying drawings.

Figure 1:
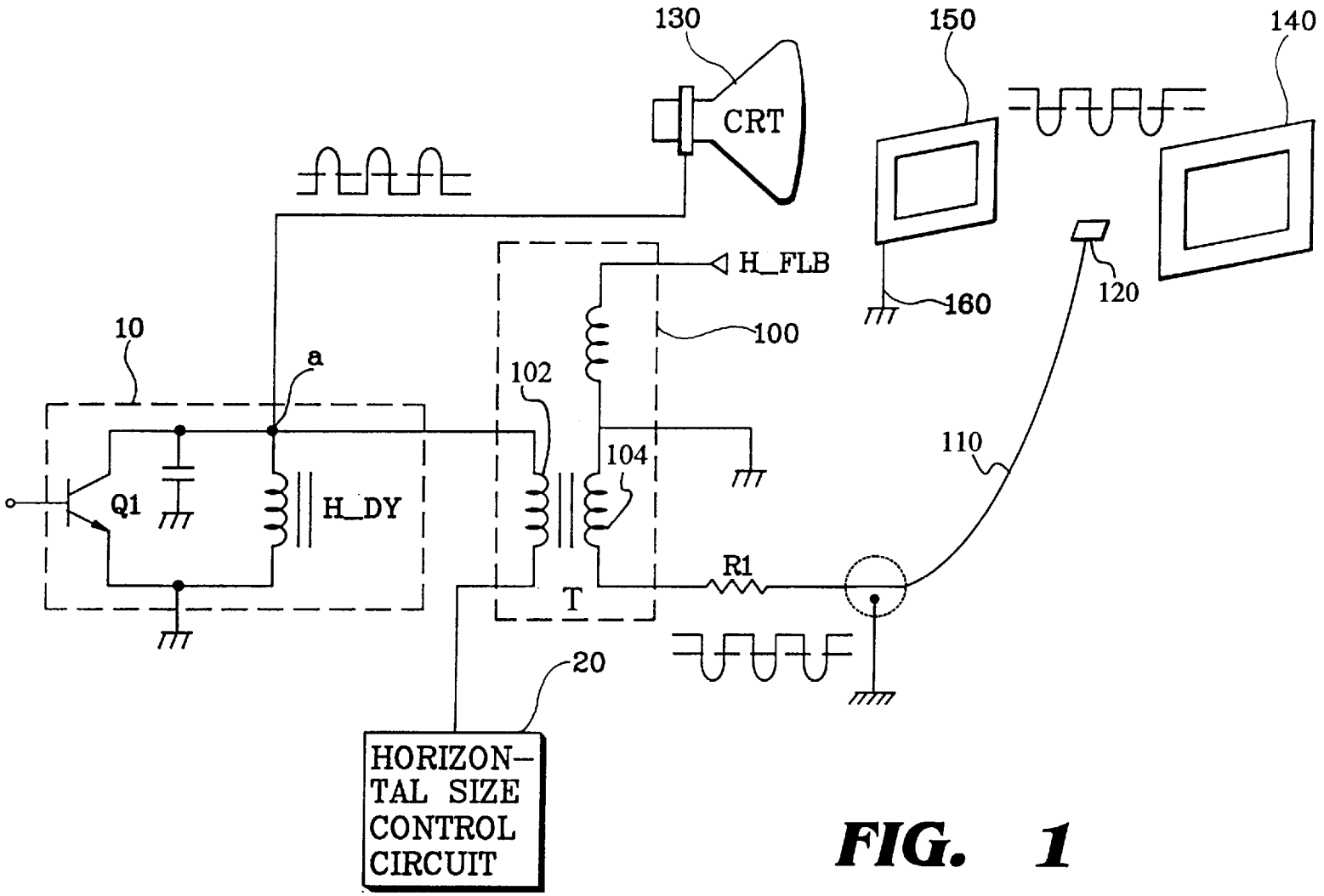
FIG. 1 is a view of the device for removing an electric field of a display in accordance with the present invention.

As shown in FIG. 1, the present invention comprises a voltage generator 100 for generating a reverse pulse, a connector 110 for detecting the reverse pulse generated by voltage generator 100 and for sending it to a rear terminal, and a reverse-pulse sensor 120 made of a conductive material for receiving from connector 110 and for diffusing the reverse pulse around the CRT so as to diminish a harmful electric field.

Voltage generator 100 comprises a transformer T having a primary coil 102 which is connected to the collector terminal of a horizontal output transistor Q1 of horizontal output circuit 10 and to a horizontal size-controller 20, and a secondary coil 104 which receives a horizontal fly-back waveform and generates the reverse pulse which is antiphase of the signal applied to primary coil 102. Secondary coil 104 of transformer T is constructed to induce the reverse pulse by winding the transformer from the ground.

Connector 110 preferably employs a shield wire and hereinafter, has a constant signal. One end of shield wire 110 is connected to secondary coil 104 of the transformer T via a resistor R1 to detect the reverse pulse, and is spontaneously connected to ground, which is to screen an unnecessary electric field that is possibly caused by the shield wire 110. Between transformer T and shield wire 110, resistor R1 is for carrying a load when a short-circuit occurs between reverse-pulse sensor 120 and the ground so as to cause no fail in the operation of the device.

Reverse-pulse sensor 120 is inserted and adhered to a given site between CRT 130 and front case 140. Reverse-pulse sensor 120 can screen a harmful electric field most efficiently when it is attached to the right top end of CRT 130 as seen from the back side of CRT 130 as shown in FIG. 2.

An effective reverse-pulse sensor 120 is preferably made of a conductive material having the size of 40 mm×15 mm or 50 mm×25 mm with a rectangular, but not limited thereto, shape. The material may include a stone, a metal and a common bronze tape, etc. To eliminate the harmful electromagnetic wave emitted to the outer side of CRT 130, metal plate 150 of a conductive material covers the front peripheral surface of CRT 130 excluding the front and back sides. With such a metal plate 150, the electromagnetic wave can be cut off from the outer side of CRT 130 and the reverse pulse of reverse-pulse sensor 120 can be more effectively diffused, provided that metal plate 150 is absolutely insulated from reverse-pulse sensor 120 and connected to ground. The metal plate 150 effectively intercepts the electric field generated from a general CRT more than from a high-quality CRT. A wire 160 is attached to a given site to metal plate 150 to connect metal plate 150 to ground. Metal plate 150 is inserted into a space between CRT 130 and front case 140.

Figure 3:
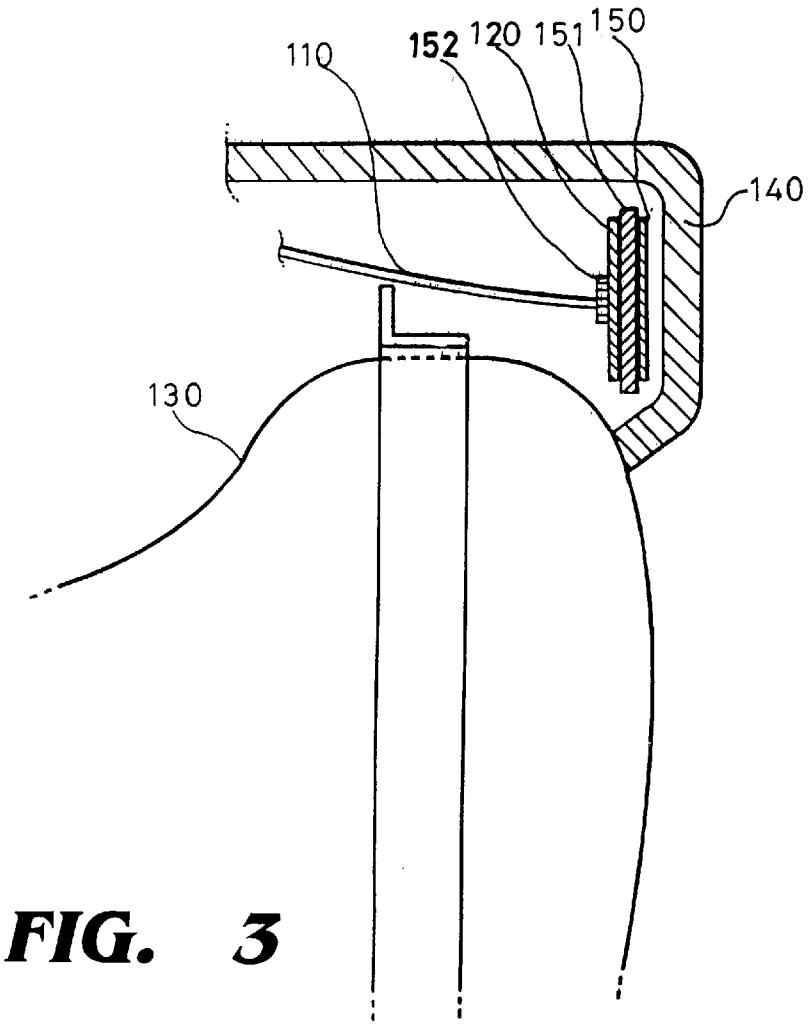
FIG. 3 is a side sectional view of a portion (A) in FIG. 2.

Reverse-pulse sensor 120 can be attached to front case 140 or, as described below, to metal plate 150. Reverse-pulse sensor 120 is attached to the metal plate 150 with an insulating adhesive 151, as shown in FIG. 3, and shield wire 110 is adhered to reverse-pulse sensor 120 by riveting or a soldering. Alternatively, reverse-pulse sensor 120 could have been fixed to front case 140 with an adhesive but an insulating tape for insulating reverse-pulse sensor 120 from metal plate 150 would be needed.

Figure 2:
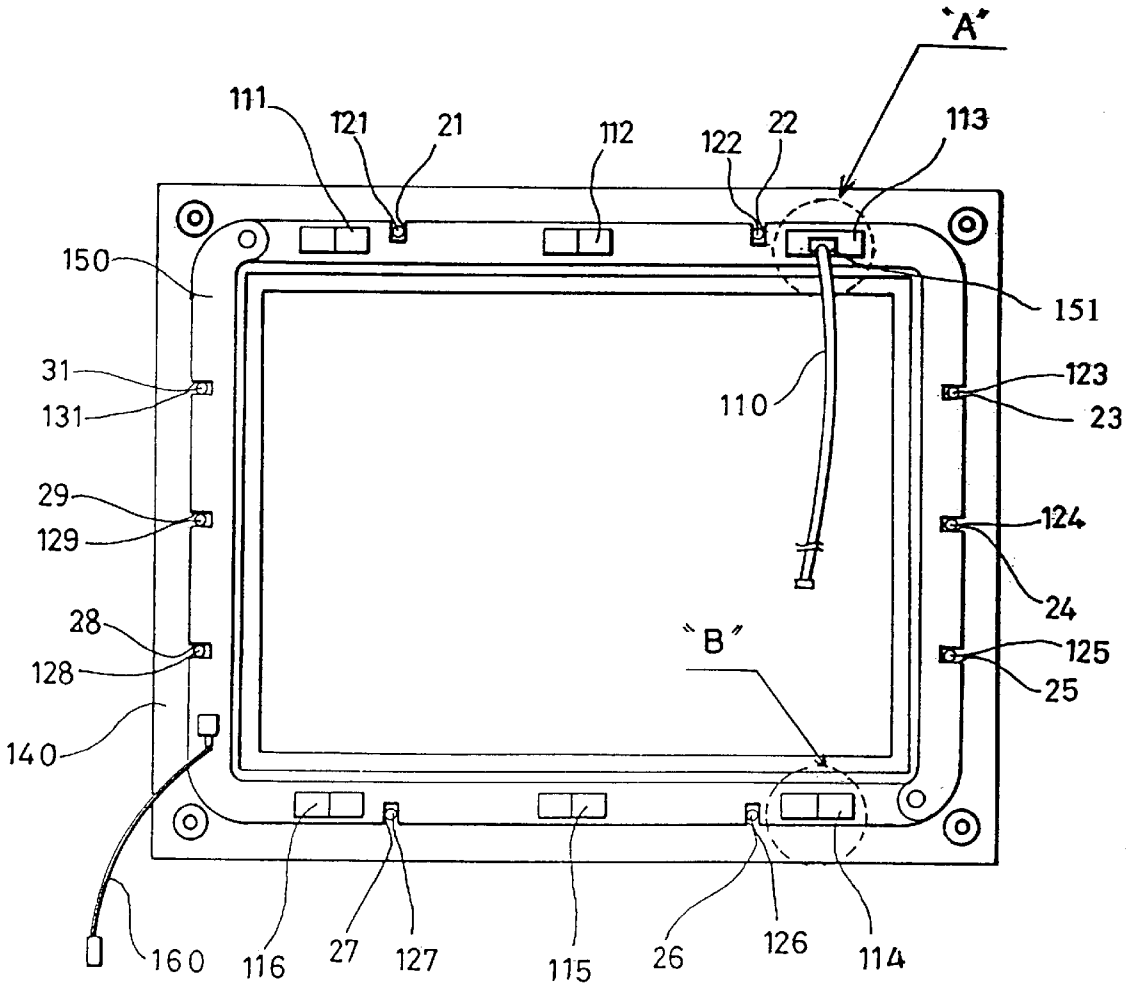
FIG. 2 is a rear elevation of the CRT in FIG. 1, showing the linkage of a metal plate and a front case.

As shown in FIG. 2, metal plate 150 is made in the form of a pair of "right angles" whose ends are riveted with one another. Thus, metal plate 150 forms a rectangle, which can save on the materials and the number of processes used in fabricating the metal plate.

Reverse-pulse sensor 120 is adjacently disposed along metal plate 150 at the portion (A) of FIG. 2 to diffuse the reverse (antiphase) pulse having the same frequency band as the horizontal deflection output pulse of the CRT around the CRT. Reverse-pulse sensor 120 is connected to a sensor wire 110 which sends the antiphase pulse to the reverse-pulse sensor 120. FIG. 3, which is an enlarged cross-sectional view of the portion (A) in FIG. 2, shows the connections of metal plate 150, reverse-pulse sensor 120 and sensor wire 110. Reverse-pulse sensor 120 is attached to metal plate 150 with an insulating adhesive 151 and reverse-pulse sensor wire 110 is adhered on the reverse-pulse sensor 120 using rivets or solder 152. Reverse-pulse sensor 120 is inserted into a space between CRT 130 and front case 140.

Metal plate 150 can absorb the pulses diffusing around CRT 130 and remove them through wire 160 connected to ground. At the same time, sensor wire 110 detects the antiphase pulse in the same frequency band of the pulse generated in the horizontal deflection output in CRT 130. The antiphase pulse detected by sensor wire 110 is sent to reverse-pulse sensor 120 for diffusion around CRT 130. Because the pulse diffused around CRT 130 has an antiphase of the pulse supplied to the anode terminal of CRT 130, the two pulses are diminished with each other and the electric field on the front side of the display can be screened.

Figure 4:
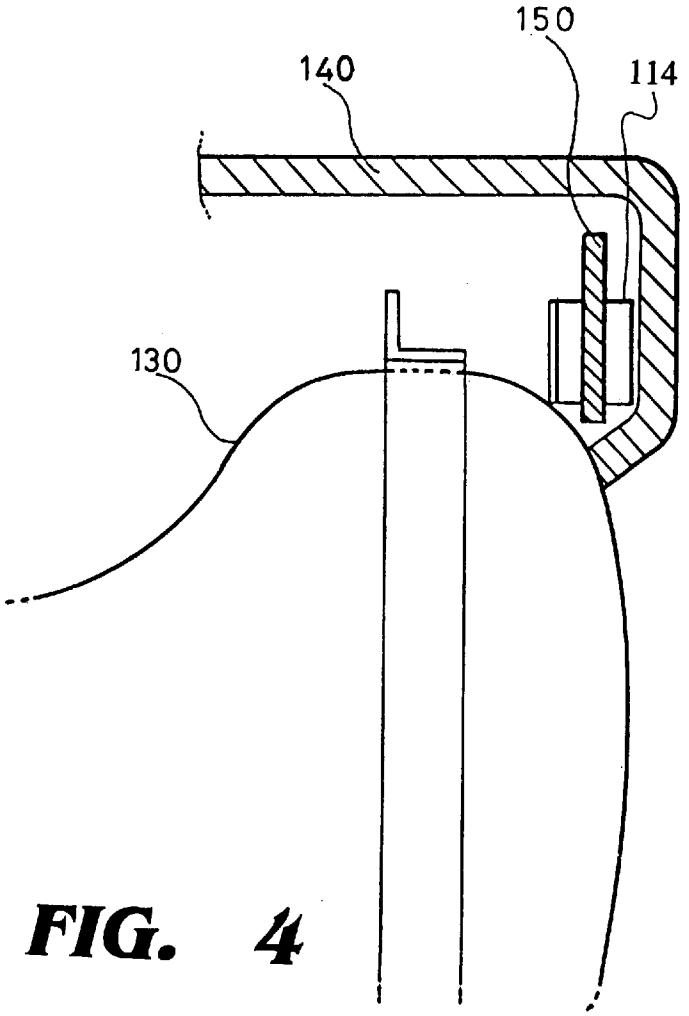
FIG. 4 is a side sectional view of a portion (B) in FIG. 2.

Additionally, as shown in FIG. 2, the outer edge portion of rectangular metal plate 150 is provided with a plurality of grooves 21 through 31 to hold a plurality of ribs 121 through 131 formed on front case 140 to prevent metal plate 150 from coming out of front case 140. Predetermined portions 111 through 116 of metal plate 150 are bent as shown in FIG. 4. FIG. 4 is an enlarged cross-sectional view of the portion (B) in FIG. 2. Bent portions 111 through 116 of metal plate 150 are elastically supported between CRT 130 and front case 140 to keep metal plate 150 from moving.

An output line is induced by the secondary coil winding by 18 turns of transformer T to which a horizontal fly-back (H_FLB) waveform is applied from a horizontal deflection output (not shown) of the CRT. The intensity of the reverse pulse naturally varies according to the number of turns of the coil. The reverse pulse occurs through the ninth turn of transformer T (or, a reverse-pulse generating transformer). This pulse is then sent to reverse pulse sensor 120 through shield wire 110 and diffused to the front side of CRT 130 so as to decrease a harmful electric wave. Shield wire 110 removes a component which may combine with the harmful electric wave and produce a reverse effect through a grounding.

To cancel the harmful electric wave more effectively, reverse-pulse sensor 120 has to diffuse a reverse pulse of about 240 V and thus must necessarily be insulated from the surrounding ground component. The horizontal output pulse of about 900–1000 V is applied to CRT 130 via a horizontal deflection yoke (H_DY) and generates a harmful electric field. The electric field can be most effectively cancelled at the front top end of the right side of CRT 130 as seen from the back side of the CRT 130.

The electric field generated on the front side of CRT 130 can be screened by reverse-pulse sensor 120 and metal plate 150 connected to ground. Reverse-pulse sensor 120 diminishes the harmful electric field by producing a cancelling electric field having an antiphase of the same frequency band of the horizontal output pulse.

The present invention employs only one rectangular reverse-pulse sensor 120 at the front top end of metal plate 150. However, it is permitted to optionally select the number and the shape of reverse-pulse sensor 120 and its location and size according to the resolution of the CRT and the range of the horizontal frequency.

In Table 2, there are TCO limited values of the electric field and the values of the electric fields respectively generated in a conventional CRT and the CRT according to the present invention.

TABLE 2

| FREQUENCY BAND COMPARISON | ELF REGION | VLF REGION |
|---|---|---|
| TCO LIMITED VALUE OF ELECTRIC FIELD | 10.0 V/m | 1.0 V/m |
| GENERAL CRT | 5.7 V/m | 2.7 V/m |
| CRT OF THE PRESENT INVENTION | 0.4 V/m | 0.76 V/m |

Table 3 shows the detailed experimental results in accordance with the present invention which employs a CRT Model No. CMH7389 made by SAMSUNG ELECTRONICS CO. Ltd. The values are the electric field which varies according to the change of a resolution and a site for measurement.

TABLE 3

| | | | TEST MODE | | | | |
|---|---|---|---|---|---|---|---|
| HORIZONTAL FREQUENCY | VERTICAL FREQUENCY | RESOLUTION | ELF BAND (V/m) | VLF BAND (V/m) | | | |
| | | | 0° | 0° | 90° | 180° | 270° |
| 31.5 | 60 | 640 × 480 | 0.4 | 0.76 | 0.18 | 0.08 | 0.07 |
| 48 | 72 | 800 × 600 | 0.3 | 0.85 | 0.20 | 0.10 | 0.07 |
| 60 | 75 | 1024 × 768 | 0.2 | 0.91 | 0.24 | 0.11 | 0.07 |
| 80 | 76 | 1280 × 1024 | 0.4 | 0.78 | 0.22 | 0.14 | 0.08 |

Where, 0° means that the electric field was measured on the front side of a monitor, 90° and 270° mean that the electric field were measured on the lateral sides of the monitor, and 180° mean that the field was measured on the back side of the monitor.

As shown in Tables 2 and 3, the present invention can screen the electric field within the TCO limited values and, especially block out the electric field of the VLF band which is difficult to control.

FIG. 5(A) is a waveform diagram of the pulse that occurs at a connection point of the collector terminal of the horizontal deflection output transistor Q1 and the deflection yoke (H_DY). FIG. 5(B) is a waveform diagram of the pulse generated by the reverse-pulse sensor 120. Further, FIG. 5(C) is a waveform diagram showing that the two waveforms of (A) and (B) are mutually diminished at a measuring point of the electric field.

As shown in FIGS. 5(A)–5(C), the electric field emitted by the CRT can be screened by diffusing an antiphase pulse of negative polarity in the front side of the CRT against the electric field of positive polarity generated by the deflection yoke. According to the present invention, there is no need to use any special filter to screen the electric field from the CRT. Furthermore, a general multi-layer coated CRT of $10^{-7}\Omega$ is employed without any technique to lower the superficial resistance of the CRT by specially coating the CRT.

It will be apparent to those skilled in the art that various modifications and variations can be made in a device for removing electric field of a display in accordance with the present invention without departing from the spirit or scope of the invention. Thus, it is intended that the present invention cover the modifications and variations of this invention provided they come within the scope of the appended claims and their equivalents.

What is claimed is:

1. A device for removing an electric field of a display, comprising:

voltage generating means connected between a horizontal output circuit and a horizontal size control circuit of a cathode ray tube, said voltage generating means generating, in response to a received horizontal fly-back signal, an antiphase reverse pulse having a frequency equal to that of a horizontal output pulse;

a front case for enclosing said cathode ray tube along a peripheral edge of a display screen of said cathode ray tube;

a metal plate attached to and insulated from said front case, said metal plate being attached to ground for dissipating an electromagnetic field produced from said display;

a reverse pulse sensor made of a conductive material, said reverse pulse sensor being adhered by an insulating material to said metal plate, said reverse pulse sensor being positioned adjacent to an upper right peripheral edge of said display of said cathode ray tube as viewed from behind said cathode ray tube; and a shielded wire for detecting said reverse pulse, said shielded wire being connected at one end thereof to said reverse pulse sensor, said shielded wire providing said reverse pulse to said reverse pulse sensor.

2. The device as set forth in claim 1, wherein said metal plate is made of a conductive material.

3. The device as set forth in claim 1, wherein said metal plate is made in the form of a pair of right angles with each end connected with one another, said metal plate thus having a rectangular shape.

4. The device as set forth in claim 3, wherein an outer peripheral edge of the rectangular metal plate is provided with a plurality of grooves for holding a plurality of ribs formed on said front case to prevent said metal plate from coming out of said front case.

5. The device as set forth in claim 1, wherein predetermined portions of said metal plate are bent and elastically supported between said cathode ray tube and said front case to prevent said metal plate from moving.

6. The device as set forth in claim 1, wherein the voltage generating means comprises a transformer having primary and secondary coils, said primary coil having one end connected to a collector terminal of a horizontal output transistor of said horizontal output circuit, said primary coil having a second end connected to said horizontal size control circuit, said secondary coil receiving said horizontal fly-back signal and generating an antiphase signal of a signal applied to said primary coil.

7. The device as set forth in claim 6, wherein said transformer is wound by the secondary coil from a ground so as to send the reverse pulse to said shielded wire.

8. The device as set forth in claim 1, wherein said shield wire provides a spontaneous connection to ground to screen an unnecessary electric field that is possibly caused by said shield wire.

9. The device as set forth in claim 1, further comprising a resistor connected between said voltage generating means and said shielded wire so as to secure a products' normal operation by carrying a load in case of a short-circuit between said reverse pulse sensor and said ground.

10. The device as set forth in claim 1, wherein said reverse pulse sensor is in the form of a rectangle of 40 mm×15 mm.

11. The device as set forth in claim 1, wherein the reverse pulse sensor is in the form of a rectangle of 50 mm×25 mm.

12. A device for eliminating an electric field of a display, comprising:

voltage generating means connected to a collector of horizontal output transistor of a cathode ray tube, said voltage generating means receiving a horizontal fly-back signal for generating a reverse pulse having a frequency antiphase to that of a pulse applied to an anode of said cathode ray tube;

a front case for enclosing said cathode ray tube along a peripheral edge of said display;

a metal plate attached to and insulated from said front case, said metal plate being attached to ground for dissipating an electromagnetic field produced from said display;

a reverse pulse sensor made of a conductive material, said reverse pulse sensor being adhered by an insulating material to said metal plate, said reverse pulse sensor being positioned adjacent to an upper right peripheral edge of said display of said cathode ray tube as viewed from behind said cathode ray tube; and shielded wire being connected to said voltage generating means at one end thereof and to said reverse pulse sensor at the other end thereof, said shielded wire providing said reverse pulse to said reverse pulse sensor, said metal plate diffusing said reverse pulse around said cathode ray tube for eliminating said electric field.

13. The device as set forth in claim 12, wherein said metal plate is made in the form of a pair of right angles with each end connected with one another, said metal plate thus having a rectangular shape.

14. The device as set forth in claim 13, wherein an outer peripheral edge of the rectangular metal plate is provided with a plurality of grooves for holding a plurality of ribs formed on said front case to prevent said metal plate from coming out of said front case.

15. The device as set forth in claim 12, wherein predetermined portions of said metal plate are bent and elastically supported between said cathode ray tube and said front case to prevent said metal plate from moving.

16. The device as set forth in claim 12, wherein said voltage generating means comprises a transformer having primary and secondary coils, said primary coil having one end connected to said collector terminal of said horizontal output transistor, said primary coil having a second end connected to a horizontal size control circuit, said secondary coil receiving said horizontal fly-back signal and generating an antiphase signal of a signal applied to said primary coil.

17. The device as set forth in claim 16, wherein said transformer is wound by the secondary coil from a ground so as to send the reverse pulse to said shielded wire.

18. The device as set forth in claim 12, further comprising a resistor connected between said voltage generating means and said shielded wire so as to secure a products' normal operation by carrying a load in case of a short-circuit between said reverse pulse sensor and ground.

19. The device as set forth in claim 12, wherein said reverse pulse sensor is in the form of a rectangle of 40 mm×15 mm.

20. The device as set forth in claim 12, wherein the reverse pulse sensor is in the form of a rectangle of 50 mm×25 mm.

* * * * *